US009427118B2

(12) United States Patent
Brouwer

(10) Patent No.: US 9,427,118 B2
(45) Date of Patent: Aug. 30, 2016

(54) FOAM DISPENSER

(71) Applicant: Minnovation B.V., Heesch (NL)

(72) Inventor: Markus Franciscus Brouwer, Heesch (NL)

(73) Assignee: Minnovation B.V., Heesch (NL)

( * ) Notice: Subject to any disclaimer, the term of this patent is extended or adjusted under 35 U.S.C. 154(b) by 0 days.

(21) Appl. No.: 14/425,612

(22) PCT Filed: Sep. 3, 2013

(86) PCT No.: PCT/NL2013/000043

§ 371 (c)(1),
(2) Date: Mar. 3, 2015

(87) PCT Pub. No.: WO2014/035237

PCT Pub. Date: Mar. 6, 2014

(65) Prior Publication Data

US 2015/0223647 A1 Aug. 13, 2015

(30) Foreign Application Priority Data

Sep. 3, 2012 (NL) ..... 1039786

(51) Int. Cl.

| | |
|---|---|
| ***B67D 7/76*** | (2010.01) |
| ***A47K 5/14*** | (2006.01) |
| ***B05B 7/00*** | (2006.01) |
| ***B05B 11/00*** | (2006.01) |
| ***B05B 11/02*** | (2006.01) |
| *A47K 5/12* | (2006.01) |

(52) U.S. Cl.

CPC ..... *A47K 5/14* (2013.01); *A47K 5/1211* (2013.01); *B05B 7/0037* (2013.01); *B05B 11/0008* (2013.01); *B05B 11/02* (2013.01); *B05B 11/3001* (2013.01); *B05B 11/3047* (2013.01); *B05B 11/3052* (2013.01); *B05B 11/3087* (2013.01); *A47K 5/1205* (2013.01)

(58) Field of Classification Search

CPC .... A47K 5/14; A47K 5/1211; A47K 5/1205; B05B 12/122; B05B 7/0043; B05B 7/0408

USPC ..... 222/190, 137, 135, 340, 383.1, 222/321.7–321.9, 402.1

See application file for complete search history.

(56) References Cited

U.S. PATENT DOCUMENTS

| | | | | |
|---|---|---|---|---|
| 5,894,958 | A * | 4/1999 | De Laforcade | B65D 83/75 222/1 |
| 7,850,048 | B2 * | 12/2010 | Arminak | B05B 11/3047 222/190 |
| 8,360,283 | B1 * | 1/2013 | Tu | B01F 5/0693 222/190 |
| 8,678,241 | B2 * | 3/2014 | Wang | B05B 7/0037 222/190 |
| 9,220,377 | B2 * | 12/2015 | Fitzpatrick | A47K 5/16 |
| 2006/0219738 | A1 * | 10/2006 | Ilzuka | A45D 34/04 222/190 |

* cited by examiner

*Primary Examiner* — Lien Ngo
(74) *Attorney, Agent, or Firm* — Seed IP Law Group PLLC

(57) ABSTRACT

A foam dispensing mechanism (100; 600) comprises: a top (113); a cylindrical wall (112; 612) extending from a peripheral edge of the top; a piston member (170) arranged within the cylindrical wall; a dispense head (120) axially displaceable with respect to the top; a resilient bias member (130) for biasing the dispense head. The piston member has a first opening (176) and a coupling cylinder (178) arranged coaxially around said first opening. The dispense head has a cylindrical seal member (150) positionally fixed with respect to the dispense head (120), the seal member (150) having a first passage opening (156) with a valve seat (151), wherein the seal member's lower portion (157) is sealingly and axially slidably coupled to the coupling cylinder. An axially displaceable valve member (190) for blocking or releasing said first passage opening has a valve stem (192) having its end (193) coupled to the piston member.

18 Claims, 17 Drawing Sheets

FOAM DISPENSER

REFERENCE TO RELATED APPLICATIONS

This application is the US National Phase Entry of International Patent Application No. PCT/NL2013/000043 filed Sep. 3, 2013, which claims priority to NL Patent Application No. 1039786 filed Sep. 3, 2012.

FIELD OF THE INVENTION

The present invention relates in general to a foam dispenser.

BACKGROUND OF THE INVENTION

As schematically illustrated in FIG. 1, a foam dispenser 1 generally comprises a container 2 having a mouth piece 3 at its top. The container 2 contains a substance 4, which turns into a foam on release. An example is soap, or shaving foam. In normal use, the container 2 is standing upright, and foam is dispensed from the mouth piece 3 by a user pressing the mouth piece down.

For achieving the dispensing action, the dispenser 1 comprises a pump mechanism actuated by the mouth piece. The combination of mouth piece and pump mechanism is typically implemented as a unit that is provided with a screw connector or a snap connector, for being screwed or snapped on a cylindrical neck portion of the container.

In prior art, the pump mechanism comprises a buffer chamber, on the one hand coupled to the interior of the container, on the other hand coupled to the mouth piece. On the down stroke of the mouth piece, a first flow path between the interior of the container and the buffer chamber is closed, a second flow path between the buffer chamber and the mouth piece is opened, the pressure within the buffer chamber is increased, and substance is pressed from the buffer chamber towards the mouth piece. On the up stroke of the mouth piece, the first flow path is opened, the second flow path is closed, the pressure within the buffer chamber is lowered, and substance is sucked from the container into the buffer chamber.

SUMMARY OF THE INVENTION

The present invention aims to offer a different design, potentially capable of being manufactured easier and cheaper. Particularly, the present invention aims to provide a soap dispenser in which the pump mechanism does not have an integrated buffer chamber that in use is subjected to alternating overpressure and underpressure.

To attain this objective, an important aspect of the present invention is that the container itself is used as a pressure chamber. The pump mechanism comprises a piston arranged in the container. The interior of the container communicates with the mouth piece. On the down stroke of the mouth piece, a first flow path between the container and the mouth piece is opened, the piston is moved down to increase the pressure in the container, and substance is pressed from the container towards the mouth piece. On the up stroke of the mouth piece, the first flow path closed, the piston is moved up and air is allowed to flow into the container to equalize the pressure in the container and to stop the flow of substance.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, in which indications "below/above", "higher/lower", "left/right" etc only relate to the orientation displayed in the drawings, and in which.

DETAILED DESCRIPTION OF THE INVENTION

Figure 1:
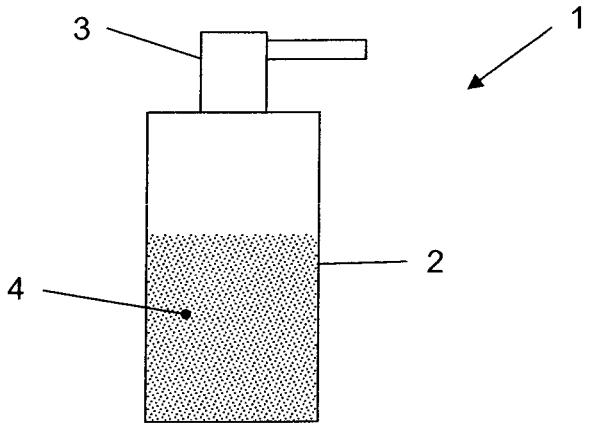
FIG. 1 schematically shows an example of a dispenser.
Figure 2:
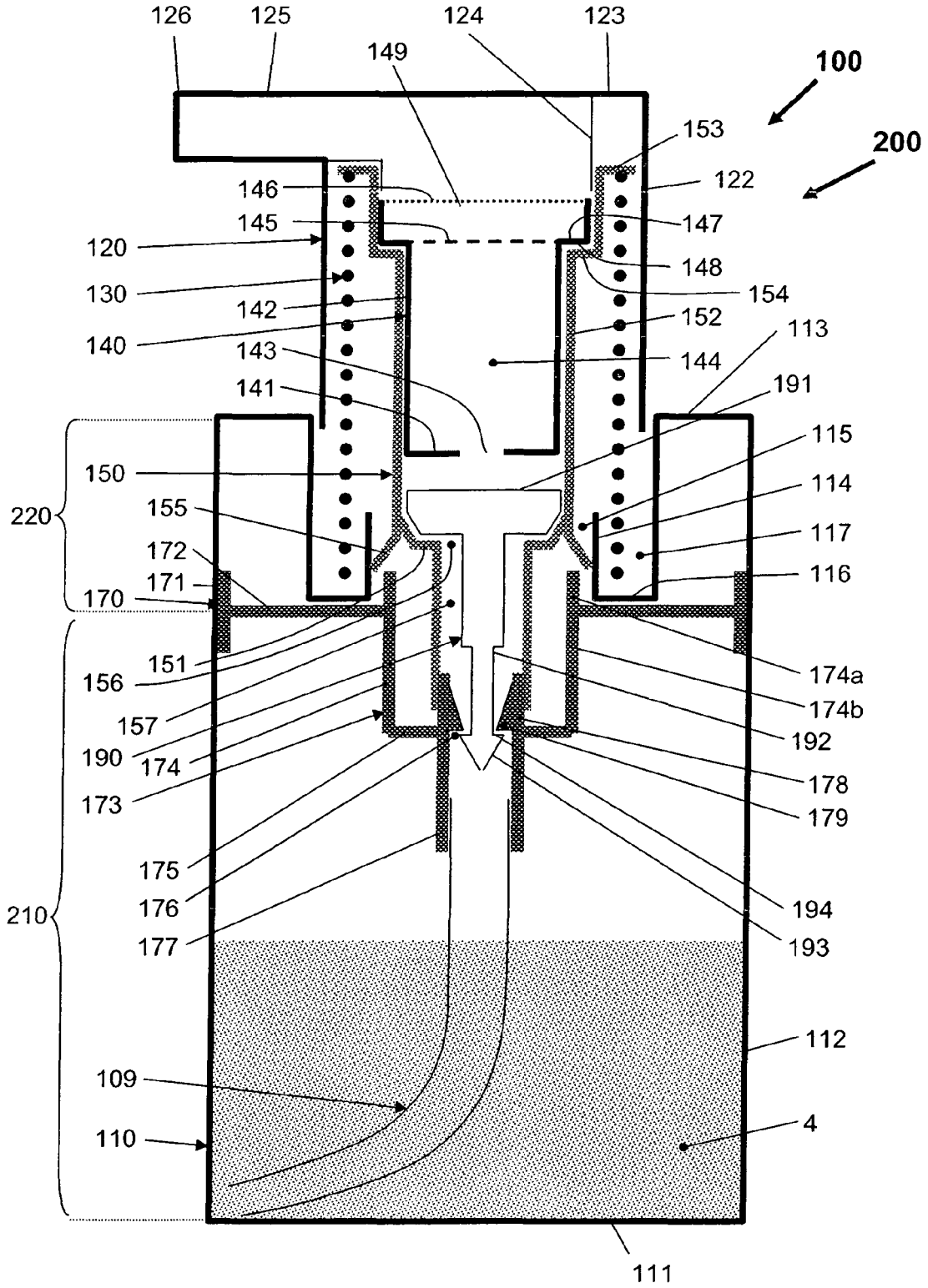
FIGS. 2-7 show schematic longitudinal sections of an embodiment of a dispenser according to the present invention, in various stages during its operation.

FIG. 2 schematically illustrates an embodiment of a foam dispenser 100 according to the present invention, in which the mouth piece is integrated with the container.

The dispenser 100 comprises a container 110, with a bottom 111, a substantially cylindrical wall 112, and a top 113. In order to allow assembly and filling, the bottom 111 is separate from the wall 112, and is attached to the wall by a snap connection, or by screwing, or welding, or any other suitable manner, as should be clear to a person skilled in the art. The top 113 has a cylindrical upright portion 114 around an opening 115. The cylindrical upright portion 114 may extend upwards from the top 113 itself, or from the bottom 116 of a recess 117, as shown.

The dispenser 100 comprises a cap-shaped dispenser head 120, having a substantially cylindrical wall 122 and a top wall 123. A cylindrical partition wall 124 extends down from the top wall 123. A dispense pipe 125 extends horizontally from an opening in the partition wall 124 through the wall 122; its free end 126 constitutes the outlet opening of the dispenser. The dispenser head 120 with this dispense pipe 125 thus constitutes the mouth piece mentioned above.

The dispenser head 120 is positioned with radial play in the recess 117. It can move axially up and down with respect to the container 110. In a possible embodiment, the dispenser head 120 is free to rotate about the vertical axis. In another possible embodiment, the dispenser head 120 has a first angular position in which the dispenser head 120 can move axially up and down with respect to the container 110, and a second position in which the axial position of the dispenser head 120 with respect to the container is fixed in order to prevent inadvertent use of the dispenser, for instance during storage and transport. The following explanation applies with the dispenser being in a situation where the dispenser head 120 can move axially up and down.

The dispenser head 120 can move down until the lower end of its wall 122 abuts the bottom 116 of the recess 117. The dispenser 100 is provided with a resilient member 130 pushing the dispenser head 120 axially upwards, away from the container 110. In the embodiment shown, this resilient member 130 is implemented as a helix spring arranged around the cylindrical upright portion 114 and within the head wall 122.

The dispenser 100 comprises a generally cup-shaped mixing chamber 140, arranged within the dispenser head 120. The mixing chamber 140 has a bottom 141 and a substantially cylindrical wall 142 with an open top. The bottom 141 has one or more openings 143, serving as entrance opening to the interior space 144 of the mixing chamber 140. The upper end of the wall 142 abuts the lower end of the partition wall 124, or is held in close proximity thereof. The open top end of the mixing chamber 140, or otherwise an opening in a top of the mixing chamber 140, serves as output opening 149 from the interior space 144 of the mixing chamber 140. It will be understood that this output opening thus communicates with the dispense pipe 125.

In its interior space 144, the mixing chamber 140 carries one or more mixing meshes 145, 146. In the embodiment shown, the mixing chamber 140 carries two mixing meshes 145, 146. Such meshes are preferably arranged in respective radial planes, as shown, at an axial distance from each other. In the embodiment shown, the lower mesh 145 is carried on an internal radial step 147 of the chamber wall 142, and the upper mesh 146 is carried on the upper end of the wall 142. Going from entrance opening 143 upwards to the top end of the mixing chamber 140, a next mesh is finer than a previous mesh.

The mixing chamber 140 is held in place with respect to the dispenser head 120 by a substantially sleeve-shaped seal member 150 having a substantially cylindrical wall 152 encompassing the mixing chamber 140 and the partition wall 124. At its top end, the seal member 150 engages the partition wall 124, so as to be axially fixed with respect to the dispenser head 120. Further, the seal member 150 has a radial flange 153 forming an upper abutment for the resilient member 130; it is noted that the bottom 116 of the recess 117 forms a lower abutment for this resilient member 130. Corresponding with said internal radial step 147, the chamber wall 142 has a radial shoulder 148, and the seal member 150 has a corresponding internal radial step 154 contacting the radial shoulder 148, so that the seal member 150 pushes the mixing chamber 140 axially upwards and holds the mixing chamber 140 fixed with respect to the dispenser head 120.

The seal member 150 comprises an annular sealing portion 155 capable of cooperating with the inner wall surface of the cylindrical upright portion 114. Advantageously, this annular sealing portion 155 is implemented as a slightly tapering skirt portion, as shown.

The seal member 150 comprises a bottom 151 with a central opening 156. The above-mentioned skirt-shaped sealing portion 155 is preferably extending downwards from the transition between wall 152 and bottom 151, as shown. The seal member 150 further comprises a cylindrical extension member 157, extending downwards from the bottom 151 and arranged around said opening 156.

The dispenser 100 further comprises a substantially disc-shaped piston member 170 arranged within the container 110, having a circumferential edge 171 for sealing against the inner surface of the container wall 112. The piston member 170 has a disc body 172, that may extend substantially radially, as shown, and a central piston cup 173 with a cup wall 174 and a cup bottom 175 having a central opening 176. The cup wall 174 has an upper portion **174*a* extending upwards from the disc body 172, and a lower portion 174*b* extending downwards from the disc body 172. The diameter of the upper portion 174*a* may differ from the diameter of the lower portion 174*b*. At its lower side, the piston member 170 carries the upper end of a dip tube 109, which extends to the bottom 111 of the container 110. For instance, the dip tube may be clamped in a cylindrical mount 177 extending downwards from the cup bottom 175 and arranged around said central cup opening 176**.

The piston member 170 divides the interior of the container 110 in a substance compartment 210 below the piston and an air compartment 220 above the piston. In use, the substance compartment 210 will be at least partly filled with substance 4. When the container 110 is standing upright, the substance 4 will be in the lower part of the substance compartment 210, with air above the substance in the upper part of the substance compartment 210.

The piston member 170 further comprises a cylindrical extension member 178, extending upwards from the cup bottom 175 and sealingly connecting to the extension member 157 of the seal member 150 while being able to be axially displaced with respect to the extension member 157 of the seal member 150. In the embodiment shown, the cylindrical extension member 178 has an outer surface sealingly sliding within the inner surface of the extension member 157 of the seal member 150, but alternatively this is the other way around.

The dispenser 100 further comprises a valve member 190 with a substantially T-shaped longitudinal section, comprising a valve head 191 and a valve stem 192 extending downwards from the valve head 191. At its lower end, the valve stem 192 is provided with an arrow-shaped stem head 193, which has a diameter larger than the diameter of the stem immediately above the stem head 193 such as to have a step-shaped transition 194 between the stem 192 and the stem head 193. The valve head 191 is resting on the bottom 151 of the seal member 150, i.e. located between the bottom 141 of the mixing chamber 140 and the bottom 151 of the seal member 150, with the valve stem 192 extending downwards through the opening 156 in the bottom 151 of the seal member 150. The stem head 193 is engaging below fixation fins 179 extending radially inwards from the inner surface of the upwards extension member 178 of the piston member 170.

Assembly is as follows. The valve member 190 is placed in the seal member 150, and the mixing chamber 140 is placed in the seal member 150, above the valve member 190. Subsequently, the dispenser head 120 is fitted on the seal member 150; this advantageously is a snap fitting. Said part together now form a head unit 200. With the container bottom 111 absent, the piston member 170 is placed in the container 110 and pushed upwards. The head unit 200 is placed on the top of the container 110, with the spring member 130 in between. The head unit 200 is pushed down and the piston member 170 is pushed up, until the stem head 193 snaps behind the fixation fins 179 of the piston member 170. To facilitate the engagement, the stem head 193 may advantageously have a tapered front face and the fixation fins 179 may advantageously have sloping top edges, as shown.

When the dispenser head 120 is now released, it is pushed up by the spring member 130. It will easily be seen that the seal member 150 pushes the valve member 190 up, which in turn takes along the piston member 170, until the piston member 170 abuts the bottom 116 of the top recess 117 (or any other stop). The assembly is now in its normal position, also indicated as rest position or transport position.

As a next step, substance is filled in the container (which to that end is typically placed upside down), after which the container bottom 111 is applied. The dispenser is now filled and ready for use. Alternatively, it is possible that the bottom is provided with a filling opening, sealed with a removable stop, so that it is not necessary to remove the entire bottom for refilling.

In use, operation is as follows.

In use, the container 110 will be standing upright, in the orientation shown in the figures. Variations are possible, for instance wall-mounted embodiments, but still the orientation will be upright.

Figure 3:
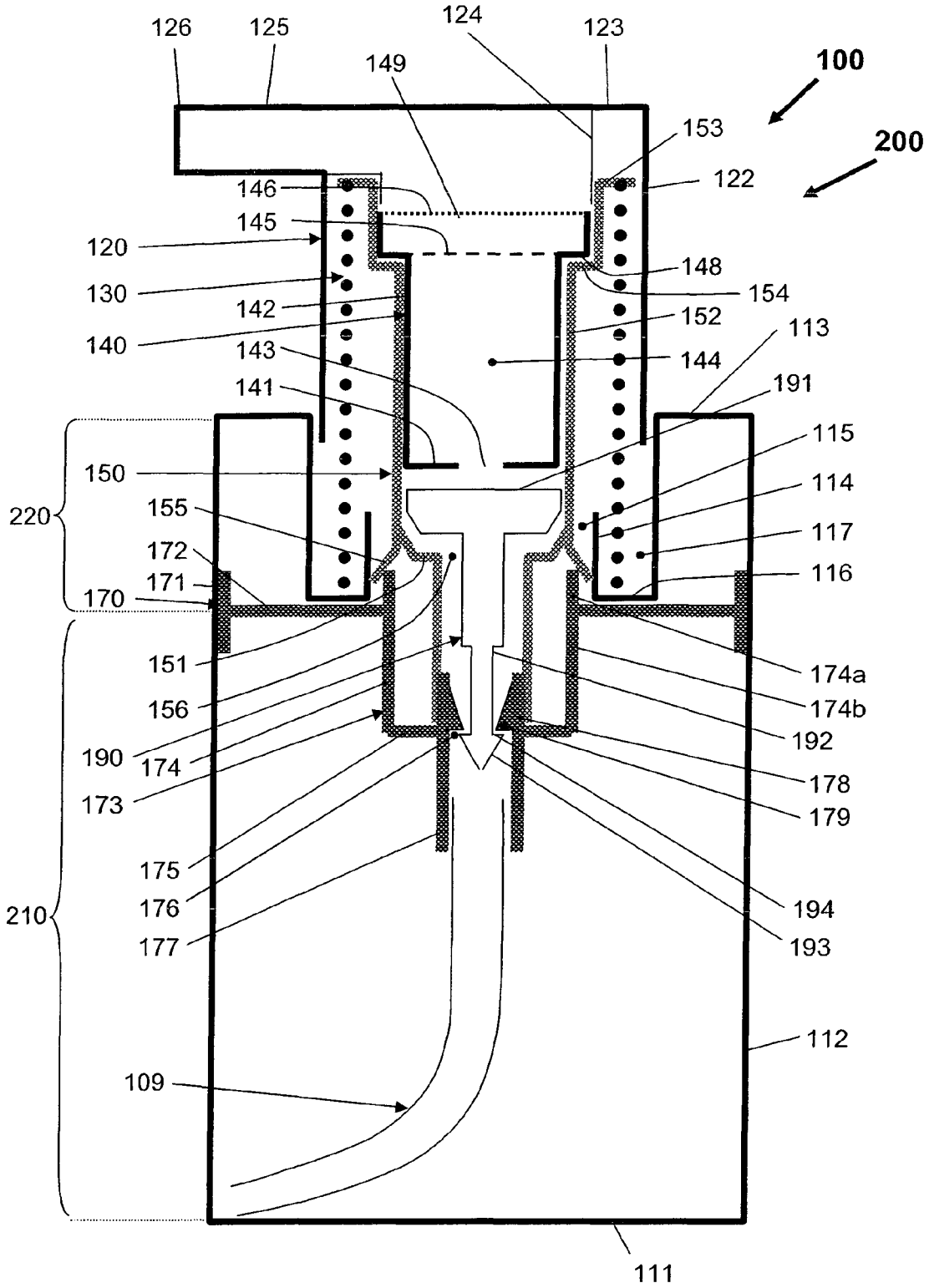

Starting from the normal position (FIG. 2), the user presses the dispenser head 120 down. The dispenser head 120 will move down, together with the mixing chamber 140 and the seal member 150, but the piston member 170 keeps its position. The valve member 190 floats, i.e. there is no net force pressing it down on the bottom 151 of the seal member 150. This phase continues until the inner surface of the annular sealing portion 155 abuts the upper edge of the cup wall 174 of the piston member 170, as shown in FIG. 3. In this position, the annular sealing portion 155 still seals against the upright portion 114.

In a second phase, the user presses the dispenser head 120 down further, so that the seal member 150 will push down the piston member 170. The annular sealing portion 155 releases the upright portion 114, and the dispenser head 120 is pushed down further. It may be assumed that the container 110 is not 100% filled with the substance 4: the container 110 is filled with substance up to a certain level, and above that level the container 110 contains air. The downwards displacement of the piston member 170 causes the air pressure within the container 110 to rise, and the increased air pressure pushes the substance 4 up through the tube 109. The substance 4 passes along the valve stem 192 and the valve head 191, through the opening(s) 143 in the bottom 141 of the mixing chamber 140 (see arrow A). In this condition, the valve head 191 may abut the bottom 141 of the mixing chamber 140; for allowing the substance to pass the valve head 191 towards the entrance opening 143 of the mixing chamber 140, a suitable profiling such as radial ridges and/or grooves may be provided on the upper surface of the valve head 191 and/or on the lower surface of the mixing chamber bottom 141.

Simultaneously, air from the container 110 is allowed to reach the mixing chamber 140 (see arrow B). The mechanism comprises an air chamber 180 between the piston 170 and the seal member 150. The piston cup 173 has one or more first air passageways 181, either in the lower cup wall portion 174*b* and/or in the cup bottom 175 outside the cylindrical mount 177, through which the air chamber 180 communicates with the interior of the container below the piston. The bottom 151 of the seal member 150 has one or more second air passageways 182, through which the air chamber 180 communicates with the interior of the upper portion of the seal member 150. The second air passageway 182 is blocked by the valve head 191 in its rest position.

The air and the substance mix with each other, already when passing the valve head 191, and finally in the mixing chamber 140, to form the desired foam, that is pressed out through the dispense pipe 125. The mixing meshes 145, 146 assist in giving the foam the desired consistency.

It is noted that ambient air is allowed into the part of the container above the piston member 170, through a first venting gap 211 between the inner surface of the upright portion 114 of the top 113 and the outer surface of the seal member 150, as indicated by arrow C.

Figure 4:
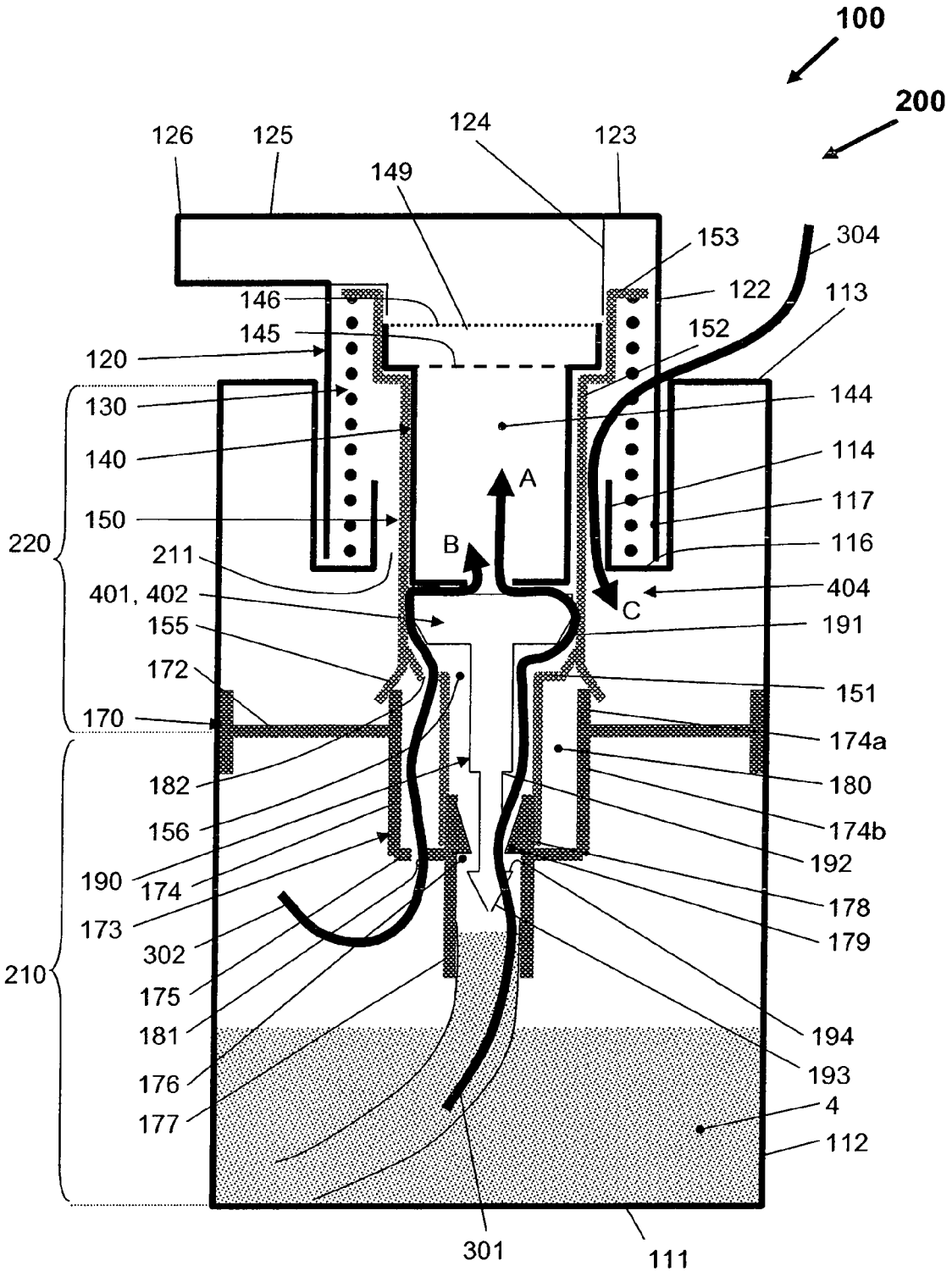

Foam is pressed out as long as the dispenser head 120 is travelling down. The down stroke of the dispenser head 120 ends when the lower end of its wall 122 abuts the bottom 116 of the recess 117; this situation is shown in FIG. 4.

When the user reduces the down force on the dispenser head 120, the dispenser head 120 and the piston member 170 remain stationary and the flow of foam out of the dispense pipe 125 stops as soon as the pressure in the container below the piston member 170 has become equal with ambient pressure.

Figure 5:
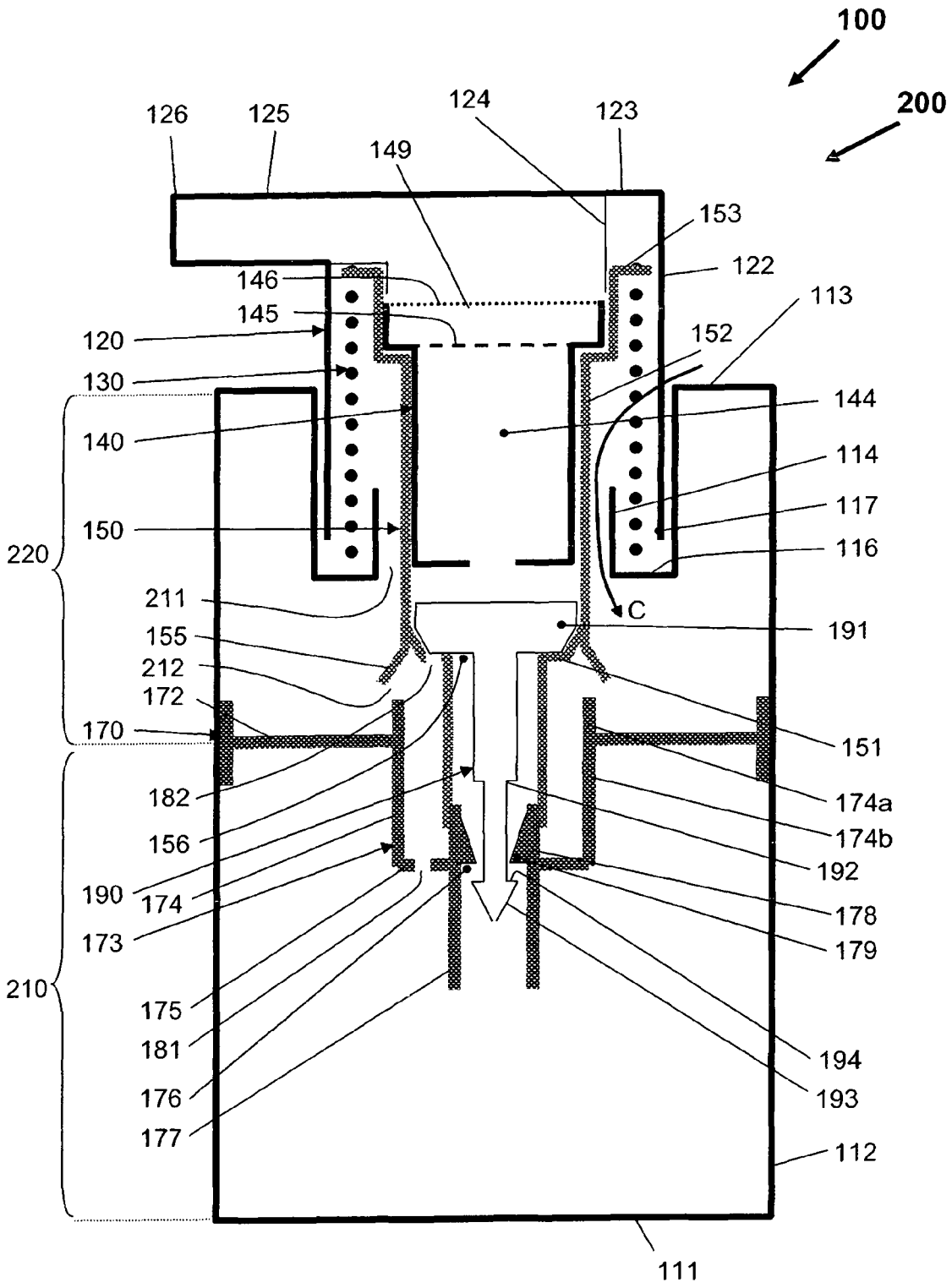

When the user takes away all down force on the dispenser head 120, the spring 130 will push the dispenser head 120 upwards. The dispenser head 120 will travel up together with the seal member 150, while the piston member 170 remains stationary. The inner surface of the annular sealing portion 155 comes free from the upper edge of the cup wall 174 of the piston member 170, causing the interior of the container 110 (below the piston member 170) to communicate with the ambient air via said first venting gap 211 and a second venting gap 212 between the annular sealing portion 155 and the cup wall 174, as shown in FIG. 5.

Figure 6:
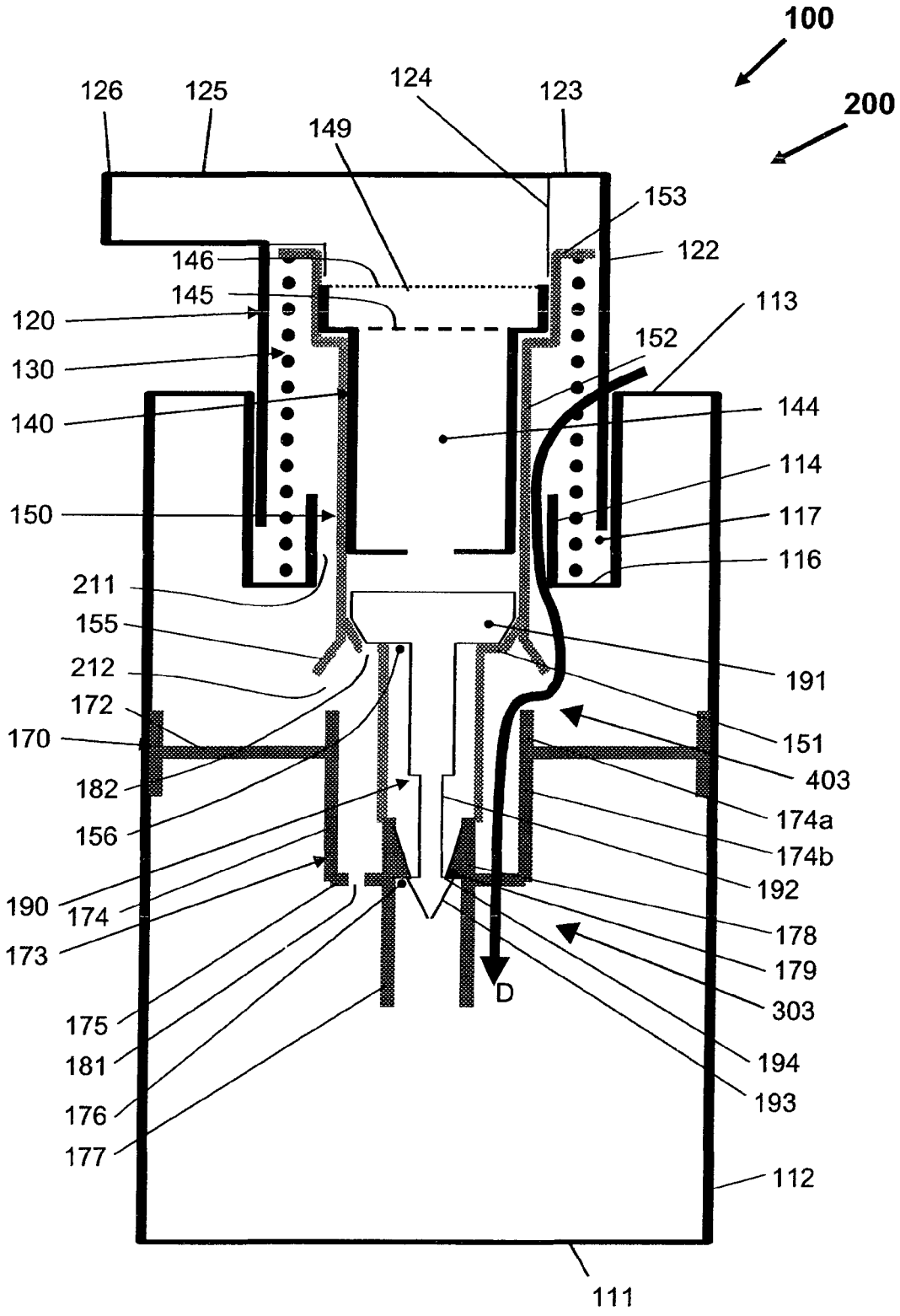

The seal member 150 travels up to close the gap with the valve member 190 (see FIG. 5), and travels further while taking along the valve member 190, until the valve member's stem head 193 contacts the fixation fins 179 of the piston member 170 (see FIG. 6); from this moment on, the travelling seal member 150 also takes along the piston member 170, while the pressure blow the piston member 170 remains equal to ambient pressure by air flow via said venting gaps 211 and 212 and passageway 181 (see arrow D).

Figure 7:
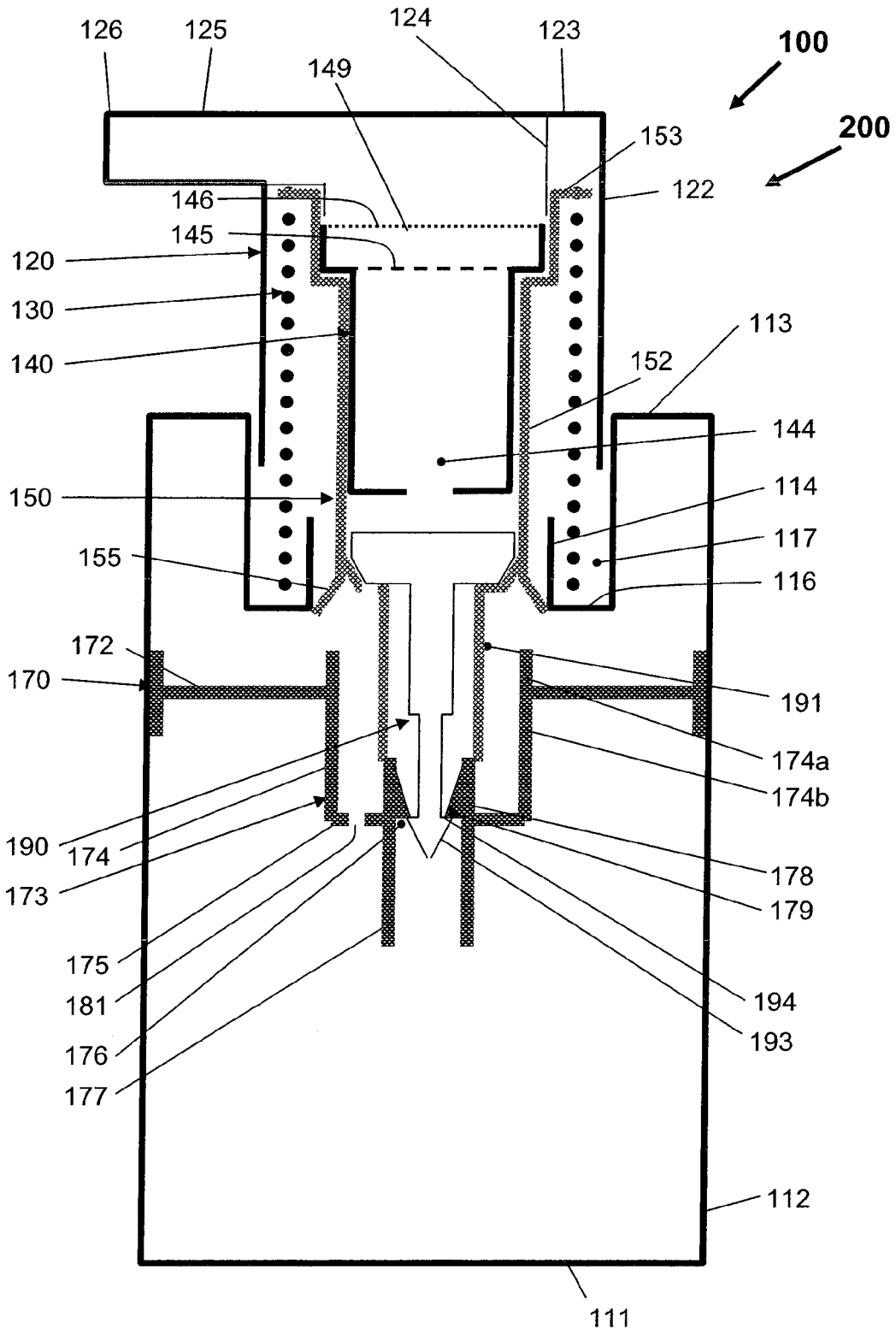

Venting is stopped when the annular sealing skirt 155 comes into contact with the upright portion 114 (see FIG. 7). This happens shortly before the dispenser head 120 reaches the end of its upstroke. This will also prevent substance from leaking away.

Thus, it will be understood that the mechanism comprises a first flow channel 301 for the foamable substance 4 extending from the substance compartment 210 to an entrance opening 143 of the mixing chamber 140, with a first valve member 401 arranged in the first flow channel 301, the first valve member 401 having a non-closed condition and a closed condition for blocking the first flow channel. The wording "non-closed" is used to indicate that it is not necessary for the valve to have a position where the passage is really "open", since it is sufficient that the valve allows flow in the channel. It is further noted that the valve, in its "non-closed" condition, does not necessarily have to allow for two-directional flow, such as an "open" valve would do: it is sufficient if the valve allows flow in an upwards direction, from the substance compartment 210 to the mixing chamber 140. In the following, as an alternative to the wording "non-closed", the wording "free" will be used.

The first flow channel 301 comprises the dip tube 109, with has its lower end arranged for immersion in the foamable substance. In the embodiment shown, the first flow channel 301 extends through the opening 176 in the piston 170, via the lower portion 157 of the seal member 150, the first passage opening 156, past the valve head 191 towards the mixing chamber 140 (see arrow A in FIG. 4). The first valve member 401 is arranged between said opening 176 and the mixing chamber 140. In the embodiment shown, the first valve member 401 is embodied by the valve head 191, which closes the first flow channel 301 as long as it abuts the bottom 151 of the seal member 150, which constitutes the valve seat for the first valve member 401.

It will further be understood that the mechanism comprises a second flow channel 302 for air extending from the substance compartment 210 to an entrance opening 143 of the mixing chamber 140, with a second valve member 402 arranged in the second flow channel 302, the second valve member 402 having a free condition for allowing air flow from the substance compartment 210 to the mixing chamber 140, and a closed condition for blocking the second flow channel. An entrance opening of the second flow channel 302 is at a higher level in the substance compartment 210 than an entrance opening of the first flow channel 301. In the embodiment shown, the second flow channel 302 extends through the vent opening 181 in the piston 170, the air passageway(s) 182 in the bottom 151 of the seal member 150, past the valve head 191 towards the mixing chamber 140 (see arrow B in FIG. 4). In the embodiment shown, the second valve member 402 is embodied by the valve head 191, which closes the second flow channel 302 when it abuts the bottom 151 of the seal member 150, which constitutes the valve seat for the second valve member 402.

It will further be understood that the mechanism comprises a third flow channel 303 for air extending from the air compartment 220 of the container 110 to the substance compartment 210 of the container 110, with a third valve member 403 arranged in the third flow channel 303, the third valve member 403 having an open condition and a closed condition for blocking the third flow channel. In the embodiment shown, the piston 170 comprises an air chamber 180. The air chamber 180 communicates with the substance compartment 210 via the vent opening 181 in the piston 170. The air chamber 180 communicates with the mixing chamber 140 via the air passageway 182. The air chamber 180 communicates with the air compartment 220 via the second venting passage 212 between the annular sealing portion 155 of the seal member 150 and the cup wall 174. The third flow channel 303 extends through the second venting passage 212, the air chamber 180, and the vent opening 181 (see part of arrow D in FIG. 6). In the embodiment shown, the third valve member 403 is embodied by annular sealing portion 155 of the seal member 150, which closes the third flow channel 303 when it abuts the upper edge of the cup wall 174, which constitutes the valve seat for the third valve member 403.

It will further be understood that the mechanism comprises a fourth flow channel 304 for air connecting the air compartment 220 of the container 110 to the exterior of the container 110, with a fourth valve member 404 arranged in the fourth flow channel 304, the fourth valve member 404 having an open condition and a closed condition for blocking the fourth flow channel. In the embodiment shown, the fourth flow channel 304 extends from the surroundings, via the first venting gap 211 between the inner surface of the upright portion 114 of the top 113 and the outer surface of the seal member 150, to the air compartment 220, as indicated by arrow C in FIG. 4. In the embodiment shown, the fourth valve member 404 is embodied by annular sealing portion 155 of the seal member 150, which closes the fourth flow channel 304 when it abuts the inner surface of the upright portion 114 of the top 113, which constitutes the valve seat for the fourth valve member 404. In the rest condition, annular sealing portion 155 is abutting the inner surface of the upright portion 114. When making the transition from the rest condition to the initial actuation condition, annular sealing portion 155 is sliding along the upright portion 114 and keeps the first venting gap 211 closed.

Figure 8A:
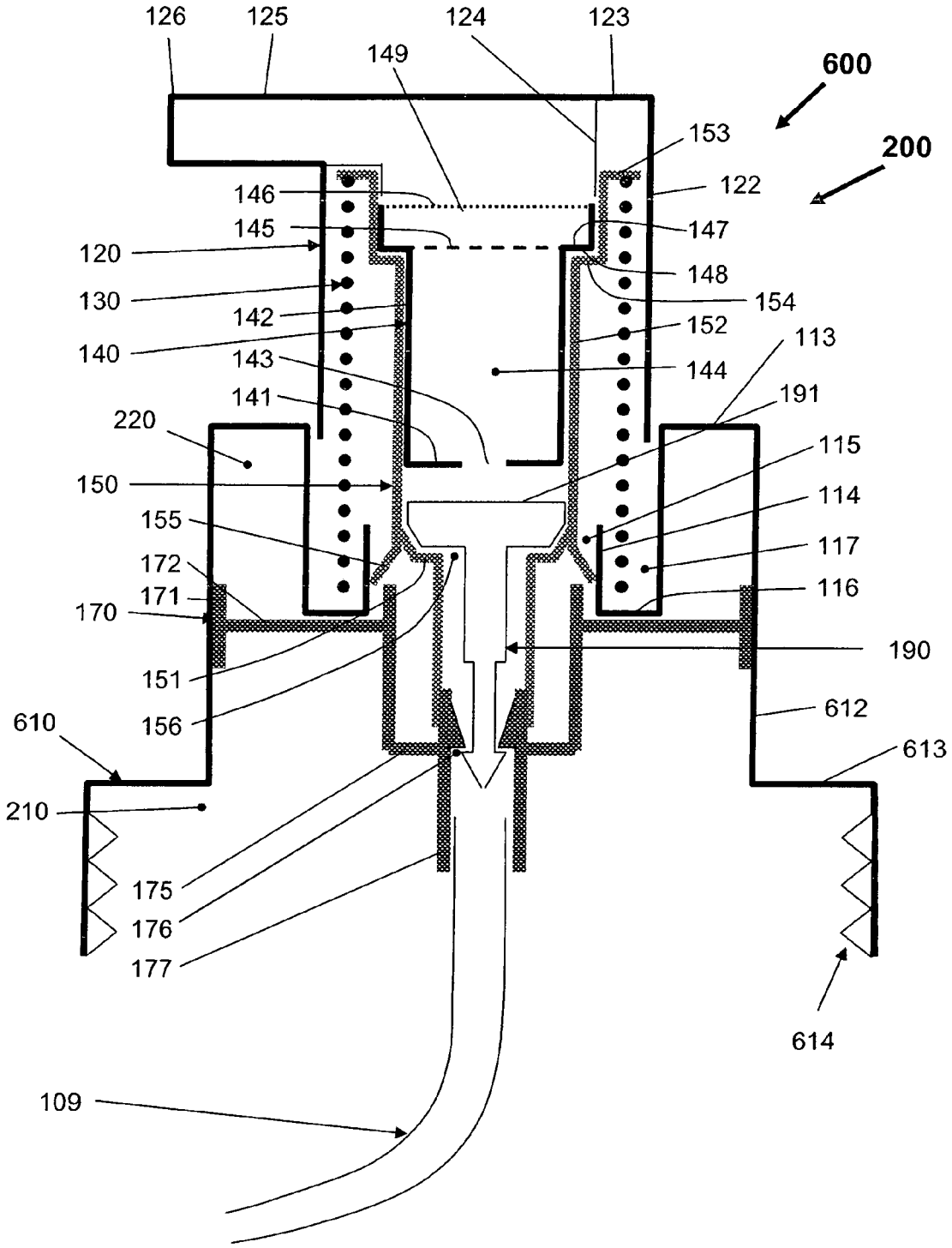
FIGS. 8A-8C schematically illustrate variations of the dispenser.

In the above embodiment, the dispensing mechanism is integrated with the container. It is however also possible to have an embodiment where the dispensing mechanism is implemented as a unit to be attached, advantageously screwed or snapped, onto a separate container. An example is schematically illustrated in FIG. 8A. The figure shows a dispensing mechanism 600, that is identical to the mechanism described in the above, with the exception that the upper part of container 110 is replaced by a screw cap 610. The top structure of the screw cap 610 is identical to the top structure of the container of the first embodiment, therefore the same reference numerals are used, and a repeated description is omitted. The screw cap 610 has a cylindrical wall 612, that is provided with a threaded portion 614, designed to mate with a threaded neck of a separate container (not shown for sake of simplicity). Such separate container may for instance be a plastic or glass bottle. The design is such that, when fitted on such container, the screw cap 610 forms a substantially airtight connection with the container. For instance, a shoulder portion 613 between the cylindrical wall 612 and the threaded portion 614 may abut the upper edge of the container neck. It should be clear that operation is the same as above, with the exception that filling of the container and subsequently screwing the cap 610 is easier; further, it is easier to unscrew the cap 610 for the purpose of refilling the container.

Figure 8B:
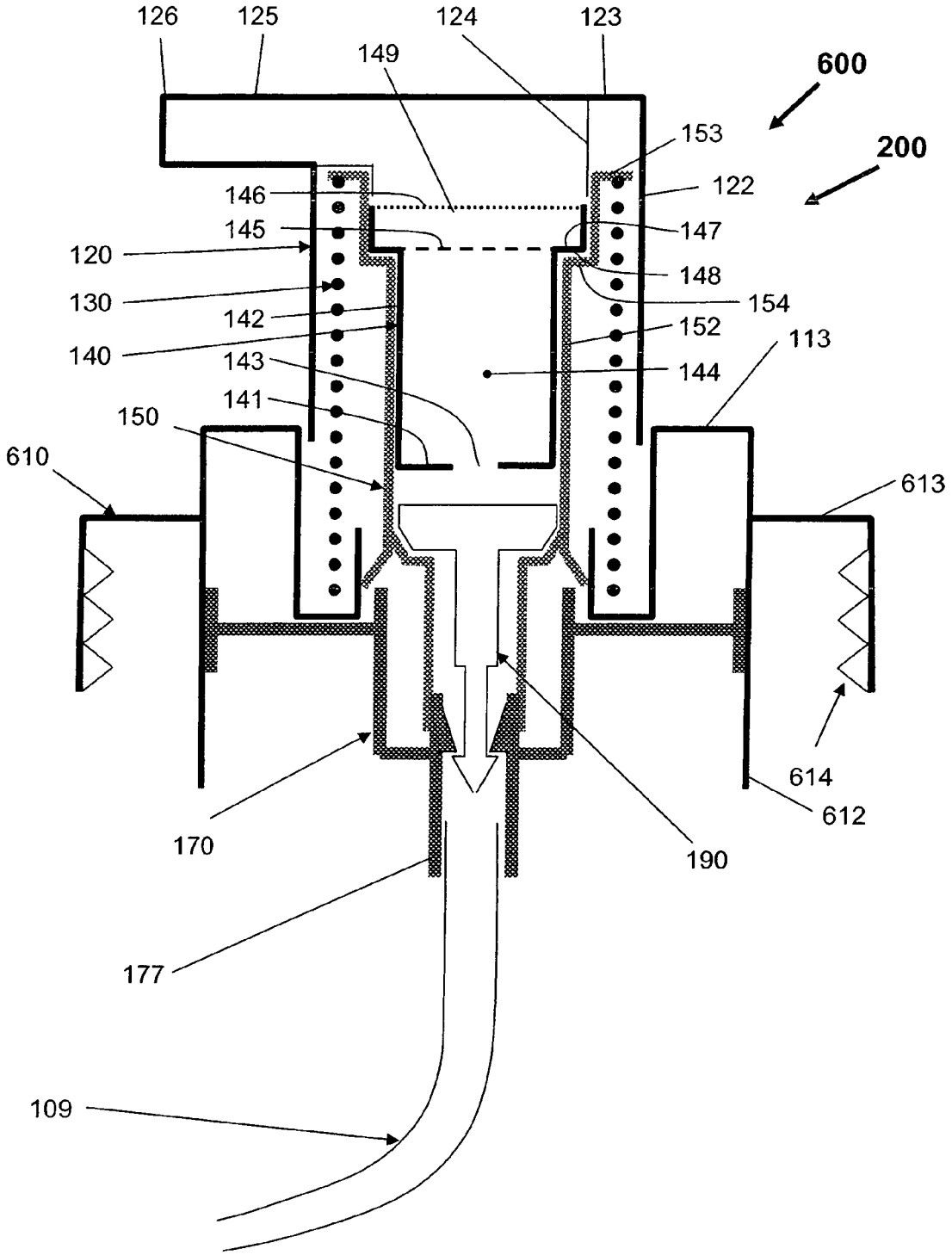
Figure 8C:
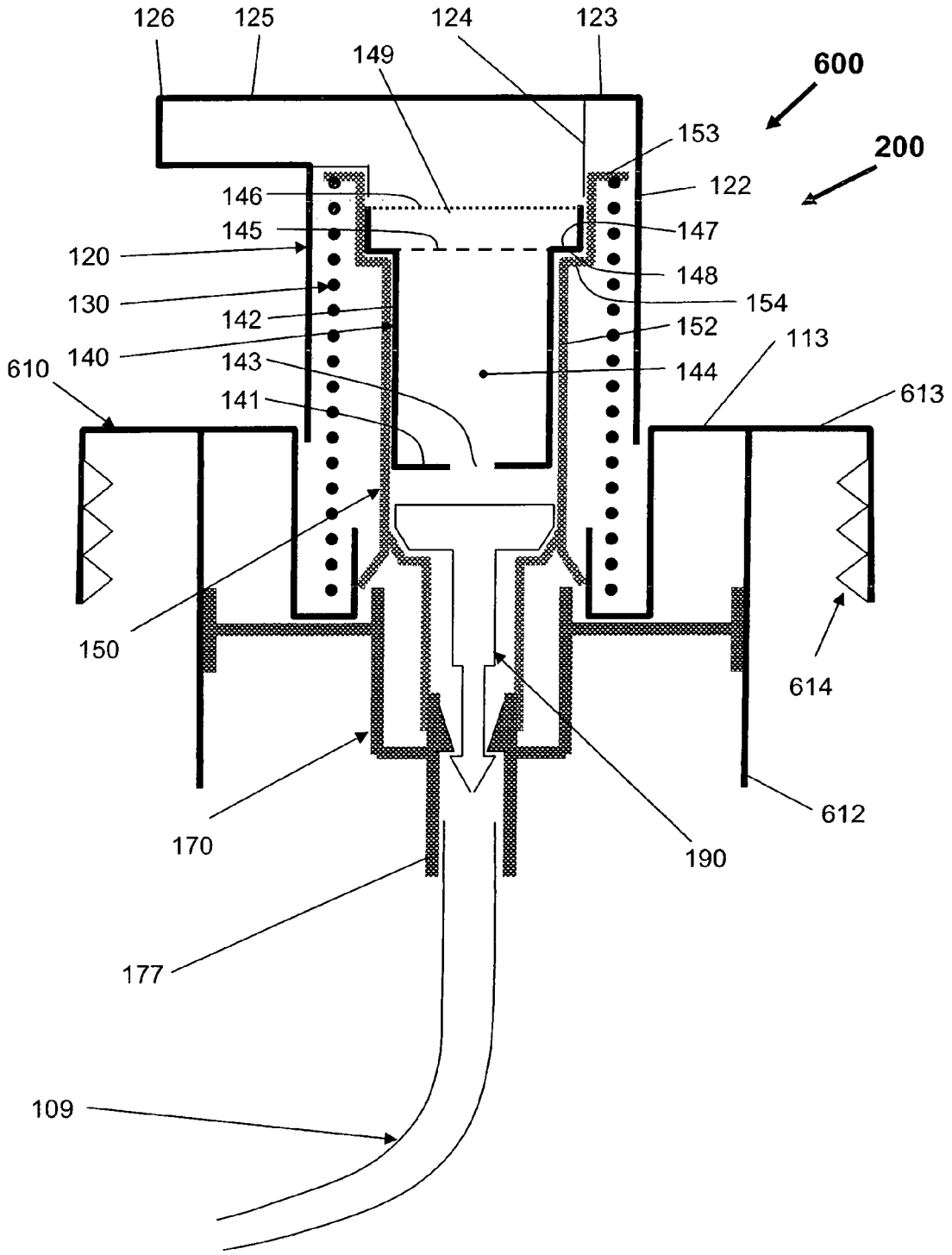

In principle, the threaded portion 614 may be attached to the cylindrical wall 612 at any level, for instance at the lower end thereof (as shown in FIG. 8A), or at a higher level (as schematically illustrated in FIG. 8B), and the shoulder portion 613 may even be flush with the top 113 (as schematically illustrated in FIG. 8C).

Instead of a screw cap, the cap may for instance be a snap cap, or the cap may be fitted to the container in another manner.

It is noted that, once the piston 170 is arranged in the cap 610, it is possible that the cap 610 is provided with a cap bottom at the lower end of its wall 612, for instance by a snap fit or a screw fit or the like. It will then be readily recognizable that the cap 610 has an interior space divided by the piston 170 in an "upper" cap compartment above the piston and a "lower" cap compartment between the piston and the cap bottom. Such cap bottom, however, is not a closed bottom as it will leave a passage for allowing tube 109 to pass, and this passage has sufficient clearance, and/or there will be at least one further passage in such cap bottom, for allowing the "lower" cap compartment to communicate with the interior of a container on which the cap is placed. For sake of convenience, and even without such cap bottom, said compartments will be indicated as "air compartment" and "substance compartment", in conformity with the previously discussed embodiment.

Whether in the form of the integrated container as illustrated in FIGS. 2-7, or in the form of the separate cap as illustrated in FIGS. 8A-8C, in both embodiments, compared to the prior art, foam transport is not achieved by underpressure but by overpressure. Since the container itself acts as pressure chamber, a separate buffer chamber is not needed any more, which allows a saving on relatively large components.

Figure 9:
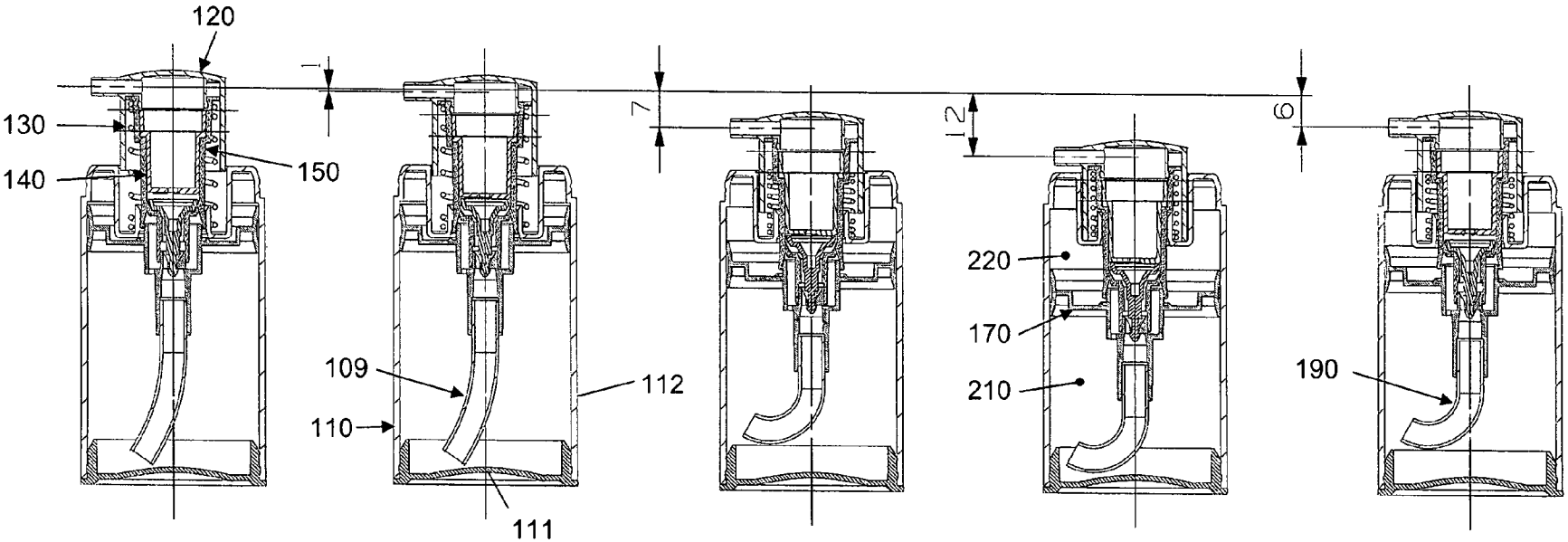
FIG. 9 shows an embodiment of a dispenser according to the present invention in the various stages during its operation.
Figure 10A:
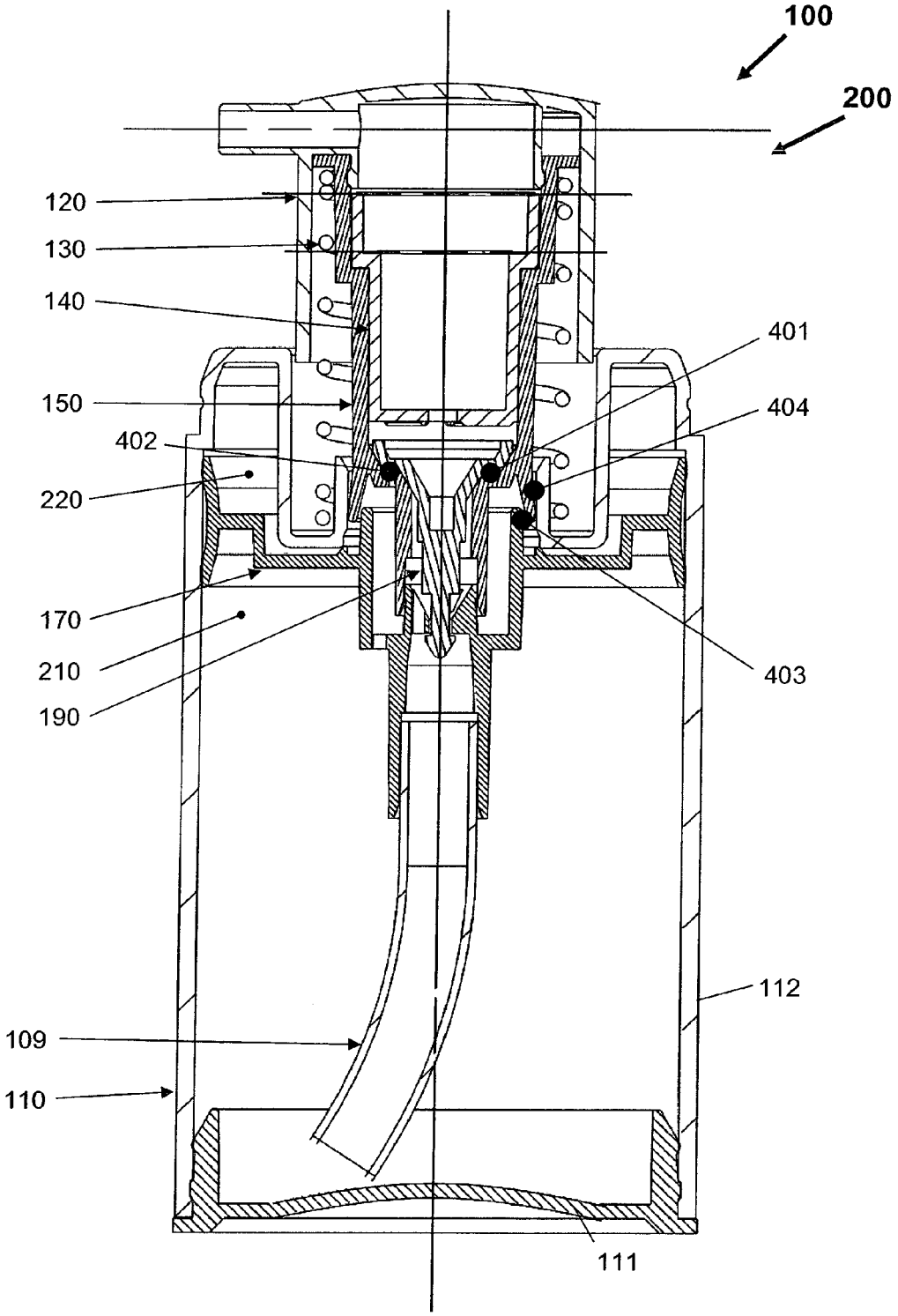
FIGS. 10A-10E show the same stages of the same dispenser at a larger scale.
Figure 10B:
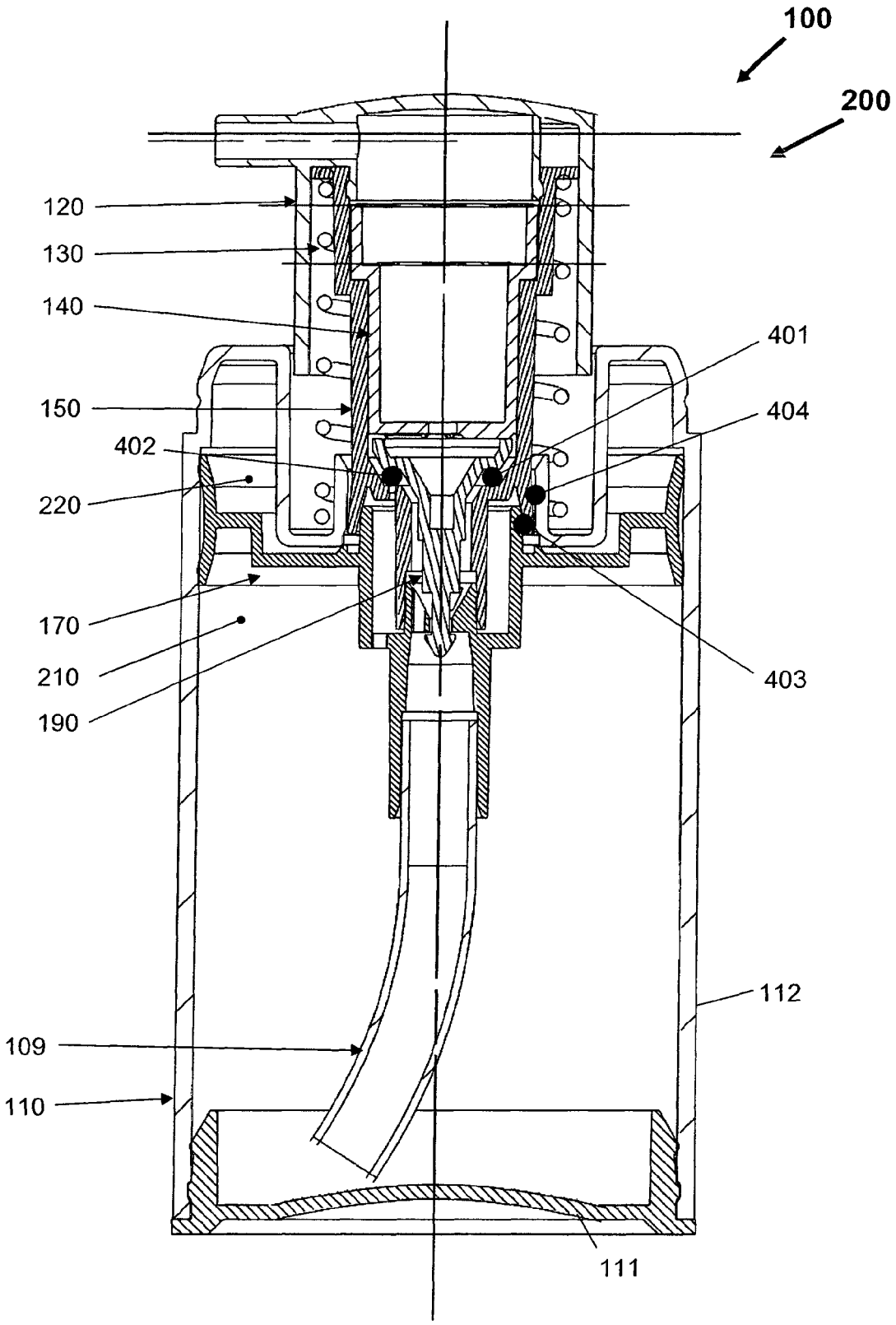
Figure 10C:
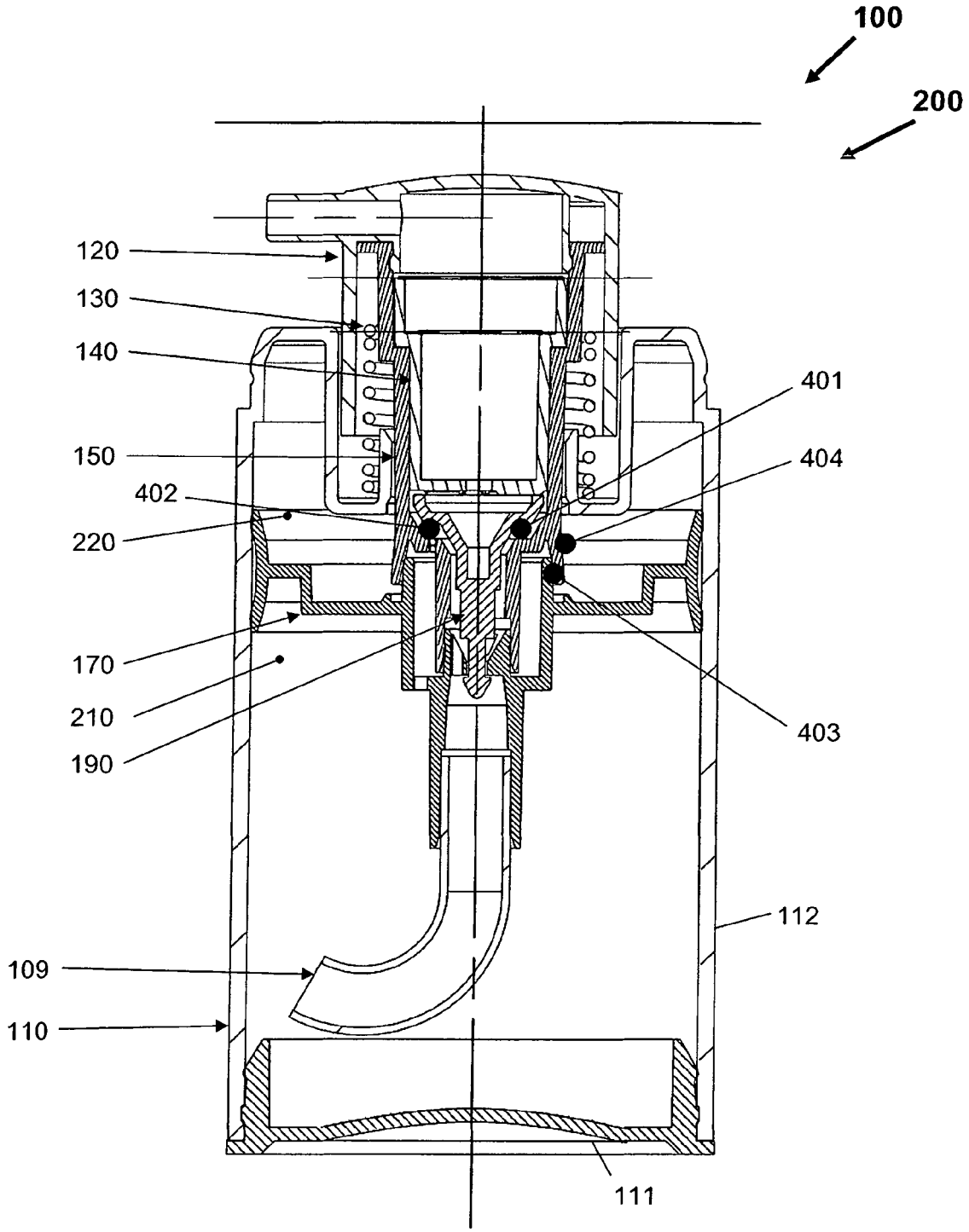
Figure 10D:
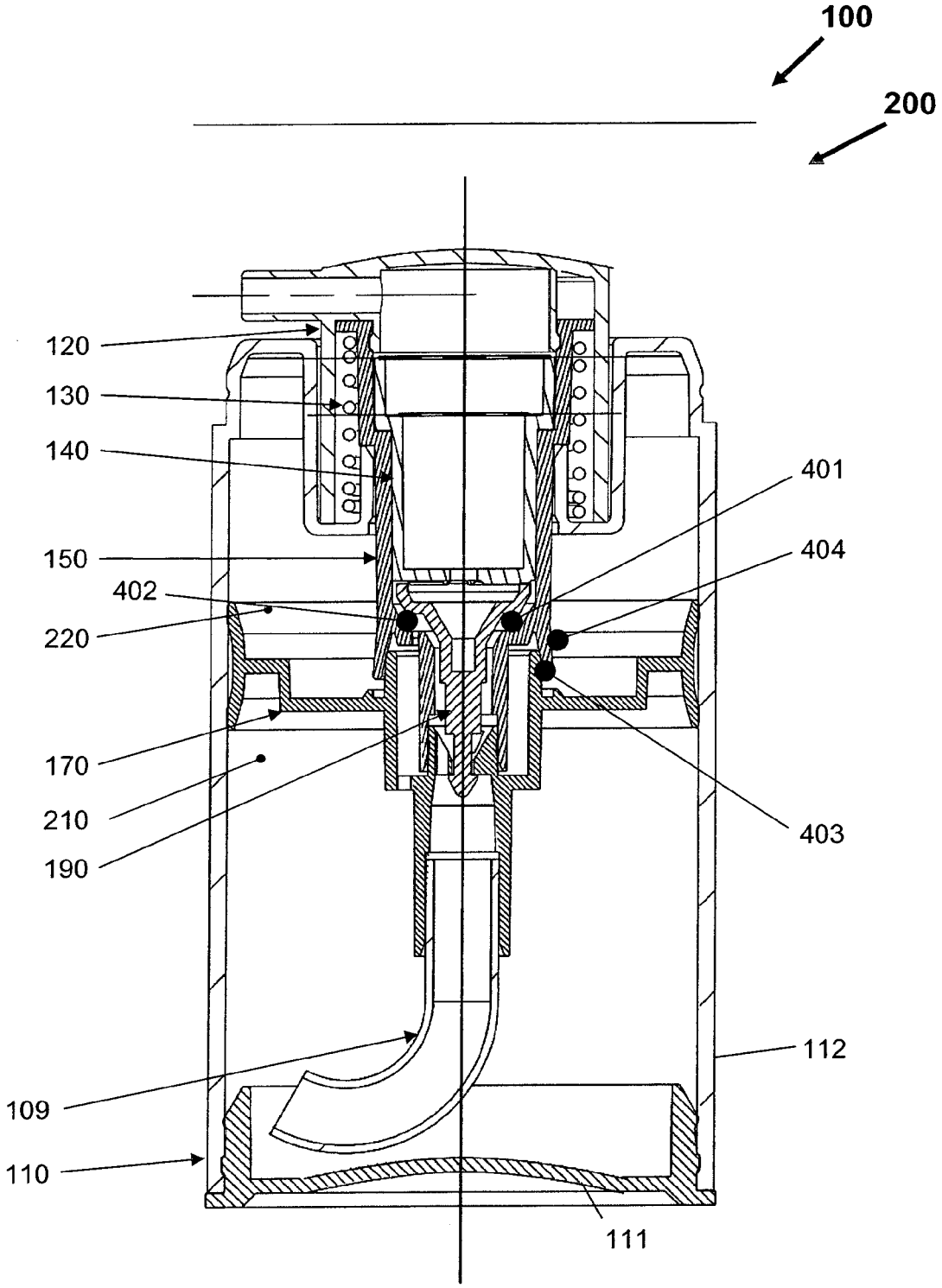
Figure 10E:
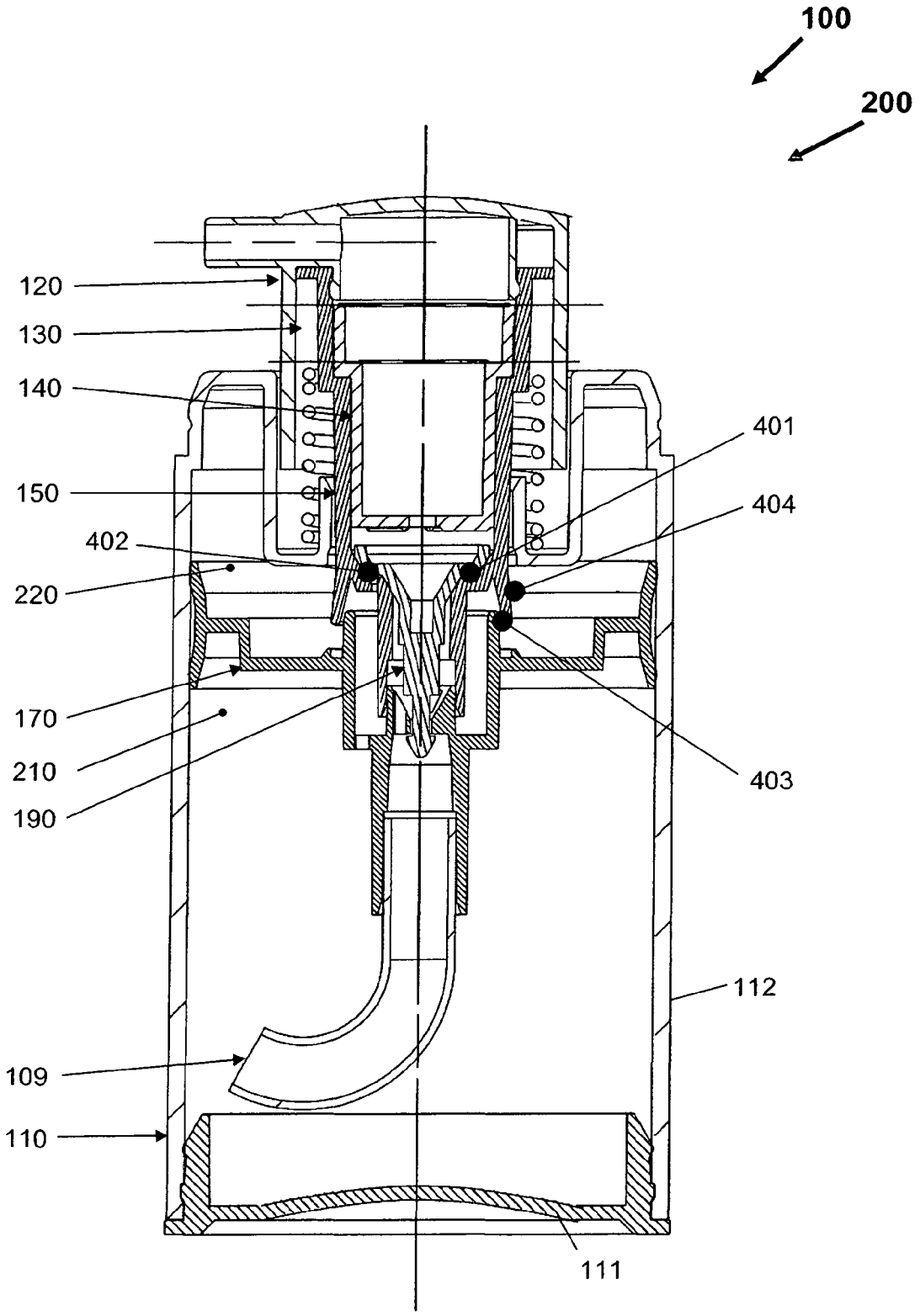

FIG. 9 illustrates the embodiment of FIGS. 2-7 in more detail, wherein the various stages of operation are shown adjacent each other. The vertical displacement of the mouth piece with respect to the normal state is indicated in millimeters for an exemplary implementation.

FIGS. 10A-10E show these stages in more detail on a larger scale.

It should be clear to a person skilled in the art that the present invention is not limited to the exemplary embodiments discussed above, but that several variations and modifications are possible within the protective scope of the invention as defined in the appending claims. For instance, two or more functions may be performed by one single entity, unit or member. Even if certain features are recited in different dependent claims, the present invention also relates to an embodiment comprising these features in common.

Any reference signs in a claim should not be construed as limiting the scope of that claim. The cylindrical components do not need to have a circular contour for implementing the present invention, although such contour is preferred.

Instead of an embodiment where the mouth piece is manipulated to actuate the piston 170, it is also possible to have a fixed dispenser outlet and a separate movable actuator for actuating the piston.

Further, instead of an embodiment with a flexible dip tube having its top end attached to the piston and its lower end lying loose at the bottom of the container, it is also possible to have a telescopic dip tube having at least two rigid telescopic tube components, an upper tube component having its top end attached to the piston and a lower tube component having its lower end attached to the bottom of the container, the upper and lower component being telescopically arranged within each other and being axially aligned with the piston. In such case, it is even possible that the upper tube component has its upper end telescopically arranged within a lower tube component 177 of the piston 170. It is even possible that the dip tube is a rigid tube having its lower end attached to the bottom of the container and having its upper end telescopically arranged within a lower tube component 177 of the piston 170.

Figure 11:
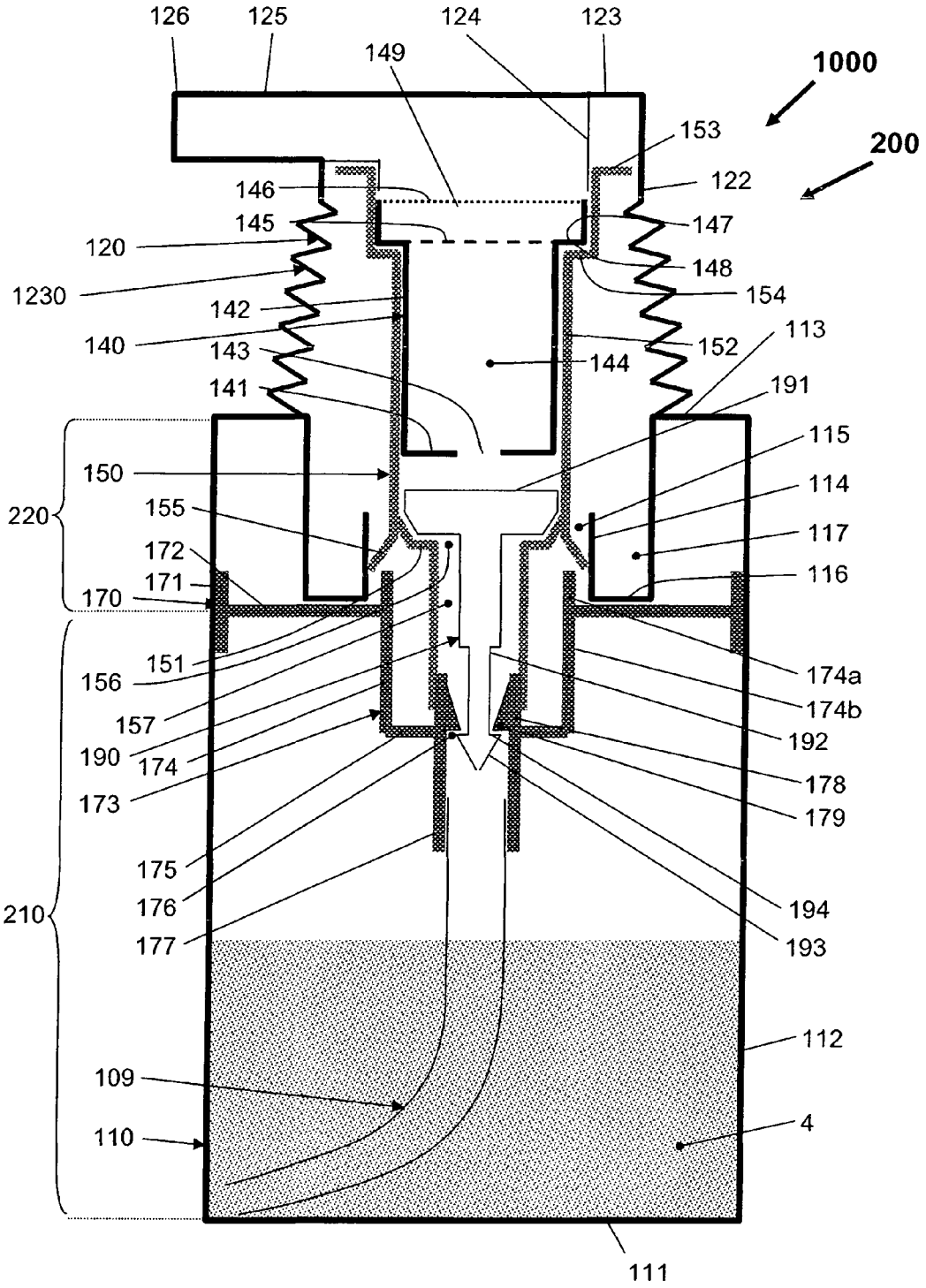
FIG. 11 is a figure comparable to FIG. 2, showing a variation of the dispenser.

FIG. 11 is a figure comparable to FIG. 2, showing a variation of a dispenser 1000, in which the spring 130 has been integrated with the dispenser head 120: the dispenser head 120 itself has here a resilient head portion 1230, preferably implemented as a bellows portion. The lower side of the dispenser head 120 rests against the container 110. The resilient head portion 1230 can be a separate item, or the dispenser head 120 with the resilient head portion 1230 can be formed as an integral one-piece whole. In either case, the resilient head portion 1230 can be formed of the same material as the remainder of the dispenser head 120, which is advantageous in the manufacturing process.

The invention claimed is:

1. A foam dispensing mechanism comprising:

a container for containing a foamable substance;

a dispense output;

a mixing chamber having an output opening communicating with the dispense output;

a pressure member for exerting pressure on the substance such as to force at least a part of the substance to flow from the container to the dispense output, wherein the pressure member comprises a piston arranged in the container, the piston dividing an interior of the container into a substance comportment below the piston and an air compartment above the piston;

an axially displaceable actuator for actuating the pressure member;

a first flow channel for the foamable substance extending from the substance compartment to an entrance opening of the mixing chamber;

a first valve member arranged in the first flow channel, the first valve member having a free condition and a closed condition for blocking the first flow channel;

a second flow channel for air extending from the substance compartment to the entrance opening of the mixing chamber;

a second valve member arranged in the second flow channel, the second valve member having a free condition and a closed condition for blocking the second flow channel;

a third flow channel for air extending from the air compartment of the container to the substance compartment of the container;

a third valve member arranged in the third flow channel, the third valve member having an open condition and a closed condition for blocking the third flow channel;

a fourth flow channel for air connecting the air compartment of the container to an exterior of the container; and a fourth valve member arranged in the fourth flow channel, the fourth valve member having an open condition and a closed condition for blocking the fourth flow channel;

wherein an entrance opening of the second flow channel is closer to the piston than an entrance opening of the first flow channel;

wherein the mechanism has a rest condition in which the first valve member is closed, the second valve member is closed, and the fourth valve member is closed, while preferably the third valve member is open;

wherein the mechanism has an initial actuation condition in which the first valve member is free, the second valve member is free, the third valve member is closed, and the fourth valve member is closed;

wherein the mechanism has a compression condition in which the first valve member is free, the second valve member is free, the third valve member is closed, and the fourth valve member is open;

wherein the mechanism has a return condition in which the first valve member is closed, the second valve member is closed, the third valve member is open, and the fourth valve member is open; and wherein the actuator is arranged such that:

a) when the actuator is not actuated, the mechanism is in the rest condition;

b) initial actuation of the actuator will cause the mechanism to make a transition from the rest condition to the initial actuation condition;

c) continued actuation of the actuator will cause the pressure means to be displaced towards the substance compartment and will cause the mechanism to make a transition from the initial actuation condition to the compression condition; and d) subsequently releasing the actuator will cause the pressure means to be displaced towards the air compartment and will cause the mechanism to make a transition from the initial actuation condition to the return actuation condition.

2. A foam dispensing mechanism comprising:

a cap having a cylindrical wall;

a mounting member for mounting the mechanism on a container for containing a foamable substance;

a dispense output;

a mixing chamber having an output opening communicating with the dispense output;

a pressure member comprising a piston arranged in the cap, the piston dividing an interior of the cap into a substance compartment below the piston and an air compartment above the piston;

an axially displaceable actuator for actuating the pressure member;

a first flow channel for the foamable substance extending from the substance compartment to an entrance opening of the mixing chamber;

a first valve member arranged in the first flow channel, the first valve member having a free condition and a closed condition for blocking the first flow channel;

a second flow channel for air extending from the substance compartment to the entrance opening of the mixing chamber;

a second valve member arranged in the second flow channel, the second valve member having a free condition and a closed condition for blocking the second flow channel;

a third flow channel for air extending from the air compartment of the cap to the substance compartment of the cap;

a third valve member arranged in the third flow channel, the third valve member having an open condition and a closed condition for blocking the third flow channel;

a fourth flow channel for air connecting the air compartment of the container to the exterior of the cap; and a fourth valve member arranged in the fourth flow channel, the fourth valve member having an open condition and a closed condition for blocking the fourth flow channel;

wherein an entrance opening of the second flow channel is closer to the piston than an entrance opening of the first flow channel;

wherein the mechanism has a rest condition in which the first valve member is closed, the second valve member is closed, and the fourth valve member is closed, while preferably the third valve member is open;

wherein the mechanism has an initial actuation condition in which the first valve member is free, the second valve member is free, the third valve member is closed, and the fourth valve member is closed;

wherein the mechanism has a compression condition in which the first valve member is free, the second valve member is free, the third valve member is closed, and the fourth valve member is open;

wherein the mechanism has a return condition in which the first valve member is closed, the second valve member (402) is closed, the third valve member is open, and the fourth valve member is open; and wherein the actuator is arranged such that:

a) when the actuator is not actuated, the mechanism is in the rest condition;

b) initial actuation of the actuator will cause the mechanism to make a transition from the rest condition to the initial actuation condition;

c) continued actuation of the actuator will cause the pressure means to be displaced towards the substance compartment and will cause the mechanism to make a transition from the initial actuation condition to the compression condition;

d) subsequently releasing the actuator will cause the pressure means to be displaced towards the air compartment and will cause the mechanism to make a transition from the initial actuation condition to the return actuation condition.

3. The foam dispensing mechanism according to claim 1, further comprising a biasing member for biasing the actuator towards the rest condition.

4. The foam dispensing mechanism according to claim 3, wherein the first flow channel comprises a dip tube with a lower end and an upper end, the lower end being arranged for immersion in the foamable substance.

5. The foam dispensing mechanism according to claim 4, wherein the first flow channel comprises an opening in the piston, and wherein the first valve member is arranged between said opening and the mixing chamber.

6. The foam dispensing mechanism according to claim 5, wherein the first valve member and the second valve member operate in synchronism, so that the first valve member and the second valve member are always opened simultaneously and are always closed simultaneously.

7. The foam dispensing mechanism according to claim 6, wherein the first flow channel comprises a passage opening with a valve seat arranged between said opening and the mixing chamber;

wherein the second flow channel comprises a second vent opening in a separation wall between the air comportment and the mixing chamber;

and wherein the first valve member and the second valve member comprise a common valve head having a condition in which the valve head closes both the passage opening and the second vent opening.

8. The foam dispensing mechanism according to claim 7, wherein the piston comprises an air chamber, a first vent opening via which the air chamber communicates with the substance compartment, an air passageway via which the air chamber communicates with the mixing chamber, and a second venting passage via which the air chamber communicates with the air compartment;

wherein the second valve member is arranged for opening or closing the air passageway;

and wherein the third valve member is arranged for opening or closing the second venting passage.

9. The foam dispensing mechanism according to claim 1, comprising:

a top;

a cylindrical wall extending from a peripheral edge of the top;

a piston member arranged within the cylindrical wall, capable of being axially displaced with respect to the cylindrical wall, and having a circumferential edge in scaling contact with an inner surface of the cylindrical wall; and a dispense head axially displaceable with respect to the top, located at the side of the top opposite the piston member, the dispense head having a dispense output;

a resilient bias member for biasing the dispense head away from the top;

wherein the piston member has a first opening and a coupling cylinder arranged coaxially around said first opening, directed towards the dispense head;

wherein the dispense head is provided with a cylindrical seal member positionally fixed with respect to the dispense head, the seal member having a relatively wide upper portion, a relatively narrow lower portion, and a first passage opening with a valve seat between the lower portion and the upper portion, wherein the upper portion communicates with the dispense output and wherein the lower portion is sealingly and axially slidably coupled to the coupling cylinder of the piston member;

wherein the mechanism further comprises an axially displaceable valve member positioned within the seal member, the valve member having a valve head located within the upper portion of the seal member for blocking or releasing said first passage opening, the valve member further having a valve stem extending through said lower portion of the seal member and having its end coupled to the piston member; and the mechanism has a rest position in which the piston member is axially resting against a stop, the valve member is engaging the piston member and the valve head is resting on the valve seat to block said first passage opening.

10. The foam dispensing mechanism according to claim 9, wherein, in the rest position of the mechanism, there is axial play between the seal member and the piston member;

and wherein, when the dispense head with the seal member is moved down towards the piston member to reach a compression position where the seal member touches the piston member, the valve head releases said valve seat such as to open said first passage opening.

11. The foam dispensing mechanism according to claim 10, wherein, in the compression position of the mechanism, when the dispense head (120) with the seal member (150) is moved down, the piston member (170) is pushed down by the seal member (150) such as to increase air pressure in a space below the piston member (170) in order to push any liquid substance (4) in said space up through the said first opening (176) of the piston member (170), through said first passage opening (156), towards the dispense output.

12. The foam dispensing mechanism according to claim 11, further comprising an air chamber defined between the piston member and the seal member; and wherein the piston member has at least one first vent opening through which said space below the piston member communicates with the air chamber;

wherein the seal member has at least one second vent opening through which the air chamber communicates with the interior of the upper portion of the seal member;

wherein, when the mechanism is in its rest position, the valve member is blocking the second vent opening;

and wherein when the mechanism is in its compression position, the valve member has released the second vent opening to allow air from said space below the piston member to pass through said first and second vent openings to mix with said liquid substance.

13. The foam dispensing mechanism according to claim 12, wherein, in the compression position of the mechanism, when the down force on the dispense head is released, the bias member pushes the dispense head with the seal member up with respect to the piston member to reach a blocked position where the valve member is engaging the piston member and blocking the first passage opening and the second vent opening.

14. The foam dispensing mechanism according to claim 13, further comprising a venting passage between the seal member and the piston member giving access to the air chamber, said venting passage being closed in the compression position by the seal member and the piston member contacting each other, and this venting passage being open in the blocked position.

15. The foam dispensing mechanism according to claim 14, wherein, in a transition from the compression position to the blocked position, the venting passage is opened before the first passage opening and the second vent opening are blocked.

16. The foam dispensing mechanism according to claim 1, wherein the actuator is provided with integrated biasing means for biasing the actuator towards the rest condition, the integrated biasing means being implemented as a bellows-shaped actuator part.

17. The foam dispensing mechanism according to claim 2, comprising:

a top;

a cylindrical wall extending from a peripheral edge of the top;

a piston member arranged within the cylindrical wall, capable of being axially displaced with respect to the cylindrical wall, and having a circumferential edge in sealing contact with an inner surface of the cylindrical wall; and a dispense head axially displaceable with respect to the top, located at the side of the top opposite the piston member, the dispense head having a dispense output;

a resilient bias member for biasing the dispense head away from the top;

wherein the piston member has a first opening and a coupling cylinder arranged coaxially around said first opening, directed towards the dispense head;

wherein the dispense head is provided with a cylindrical seal member positionally fixed with respect to the dispense head, the seal member having a relatively wide upper portion, a relatively narrow lower portion, and a first passage opening with a valve seat between the lower portion and the upper portion, wherein the upper portion communicates with the dispense output and wherein the lower portion is sealingly and axially slidably coupled to the coupling cylinder of the piston member;

wherein the mechanism further comprises an axially displaceable valve member positioned within the seal member, the valve member having a valve head located within the upper portion of the seal member for blocking or releasing said first passage opening, the valve member further having a valve stem extending through said lower portion of the seal member and having its end coupled to the piston member; and wherein the mechanism has a rest position in which the piston member is axially resting against a stop, the valve member is engaging the piston member and the valve head is resting on the valve seat to block said first passage opening.

18. The foam dispensing mechanism according to claim 2, wherein the actuator is provided with integrated biasing means for biasing the actuator towards the rest condition, the integrated biasing means being implemented as a bellows-shaped actuator part.

* * * * *